United States Patent [19]

Mandolesi

[11] Patent Number: 5,015,115

[45] Date of Patent: May 14, 1991

[54] INTERCHANGEABLE SHEET ALBUM FOR PHOTOGRAPHS AND CARDS

[75] Inventor: Benito Mandolesi, Bertinoro, Italy

[73] Assignee: Linea BM di Mandolesi Benito & C. S.n.c., Forli', Italy

[21] Appl. No.: 398,348

[22] Filed: Aug. 24, 1989

[30] Foreign Application Priority Data

Sep. 15, 1988 [IT] Italy ..... 12028 A/88

[51] Int. Cl.[5] ..... B42F 13/00

[52] U.S. Cl. ..... 402/56; 402/46; 402/55; 402/80 R

[58] Field of Search ..... 402/56, 46, 55, 80 R, 402/8, 26, 70; 281/19.2, 51, 29, 36

[56] References Cited

U.S. PATENT DOCUMENTS 2,314,204 3/1943 Fontecilla ..... 402/55

*Primary Examiner*—Frank T. Yost
*Assistant Examiner*—Thomas Hamill, Jr.
*Attorney, Agent, or Firm*—Guido Modiano; Albert Josif

[57] ABSTRACT

This album with interchangeable sheets has coupling elements for the sheets which are preferably made of plastics, are fixed on the inner side of the rear cover and can be opened after extracting closure profiled elements which are mutually aligned and are parallel to the spine of the binder. The sheets may easily be turned since they have slots which are particularly enlarged with respect to the cross section of the coupling elements. Furthermore a perfect alignment of the sheets is obtained in a very simple and original manner, by virtue of raised portions which also protrude from the inner side of the rear cover and act against an appropriately shaped inner edge of the sheets.

8 Claims, 6 Drawing Sheets

6
7
1
8

6
1
6A
1A
7
7A
2A
4
2
3
4A
2A
2A
3A
2
3
7
6

3
2
1
4
3A
3C
3B
8A
8
5

15
11C
10
9
11A
12
11
11B
16A
16
14

19B
22
19C
21A
18
17
19A
19
20
21
23A
23

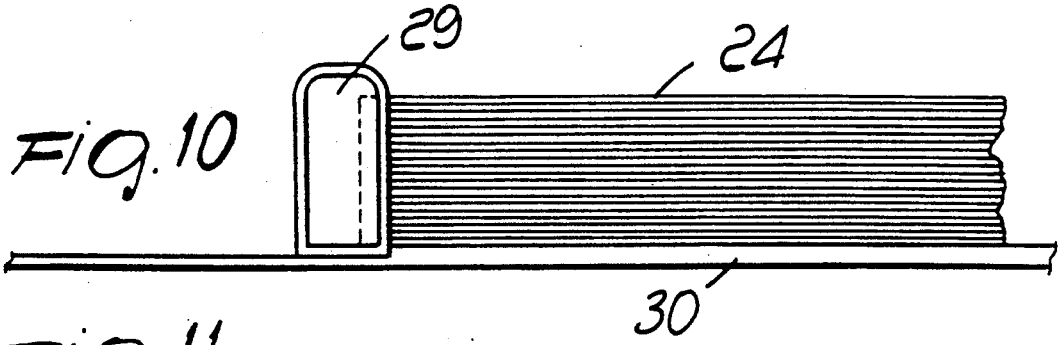
FIG. 10
FIG. 11
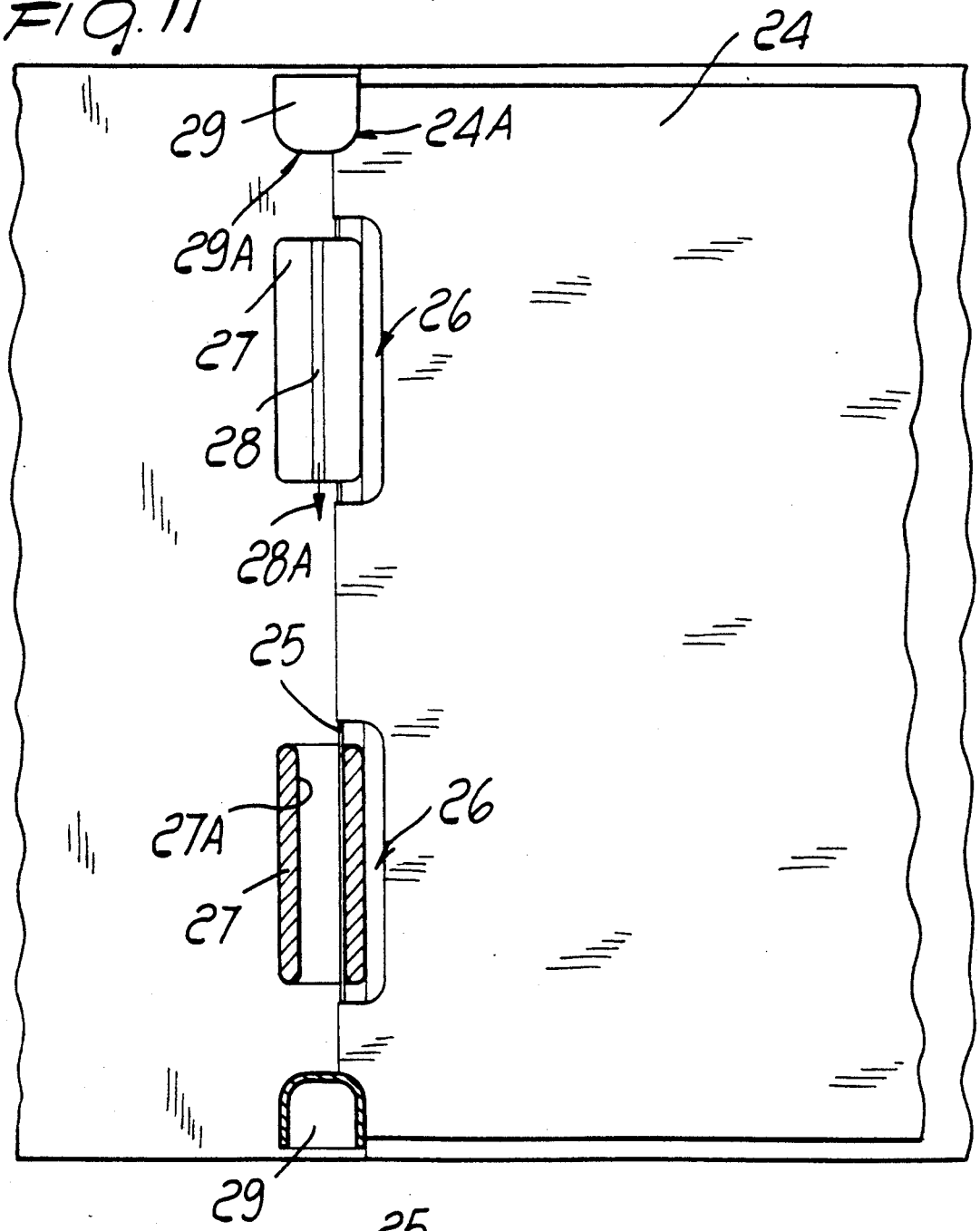
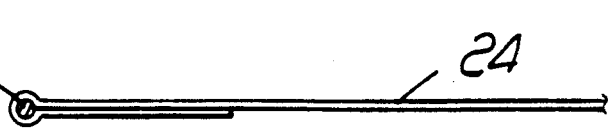
FIG. 12

INTERCHANGEABLE SHEET ALBUM FOR PHOTOGRAPHS AND CARDS

BACKGROUND OF THE INVENTION

The present invention relates to an interchangeable sheet album for photographs and cards.

The practical advantages of a photo album with interchangeable sheets could be various and easily imaginable. However, this kind of album cannot be made similarly to traditional filing card binders, since conventional snap-closing metallic devices would be aesthetically unsuitable, and also because it is know that it is difficult to turn the cards over, since during the rotation movement the holes of the cards tend to lock on the rings to which they are coupled. On the other hand, it is not possible to excessively increase the size of the coupling holes, since this would not allow to obtain a correct and aesthetically necessary superimposition of the sheet or cards.

SUMMARY OF THE INVENTION

The aim of the present invention is to provide albums with interchangeable sheets for photographs and filing cards without the described limitations and disadvantages.

The proposed improvements in fact provide coupling means which are preferably made of plastics, are fixed on a inner side of the rear cover, and are upwardly closed by a profiled element which can be extracted with a movement which is parallel to the spine of the album. The coupling means are inserted into through slots provided in the sheets, and the perfect superimposition of the sheets is ensured by one or more raised portions which may also be made of plastics, are fixed to the inside of the rear cover in alignment with the coupling means and act against the appropriately shaped inner edge of the sheets, forcing them to rest with the edge of the through slots against the innner surface of the coupling means. Naturally, this occurs when the album is closed or when the sheets are in any case parallel to the cover. In order to facilitate the overturning of the sheets, the through slots are considerably larger than the cross section of the coupling elements and the raised guiding portions have a vertical height less than the vertical height of the coupling elements. Therefore, when each sheet is turned over, the support (that is the engagement of the sheet edges with the raised portions) is no longer provided, an increase in play exists between the slots and the inner surfaces of the coupling elements, and the movement is increasingly facilitated as the sheet is lifted and inclined to thereby turn it over.

In known binders, on the other hand, the lifting and inclination of the sheets forces the holes to lock on the coupling rings, making the sheets difficult to turn over.

BRIEF DESCRIPTION OF THE DRAWINGS

The drawings, which are enclosed only by way of non-limitative example, illustrate some of the different embodiments of the present invention.

FIGS. 10 and 11 are respectively partially sectional side and front views of an open album, according to a fourth embodiment;

FIG. 12 is a side view of a sheet of the album according to FIGS. 10 and 11;

DESCRIPTION OF THE PREFERRED EMBODIMENTS

Figure 1:
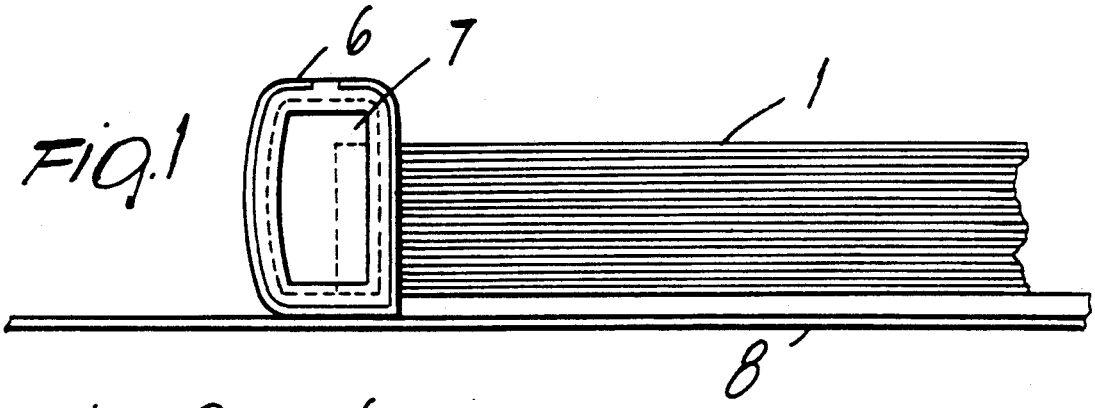
FIGS. 1 and 2 are respectively partially sectional side and front views of an open album in a first embodiment.
Figure 2:
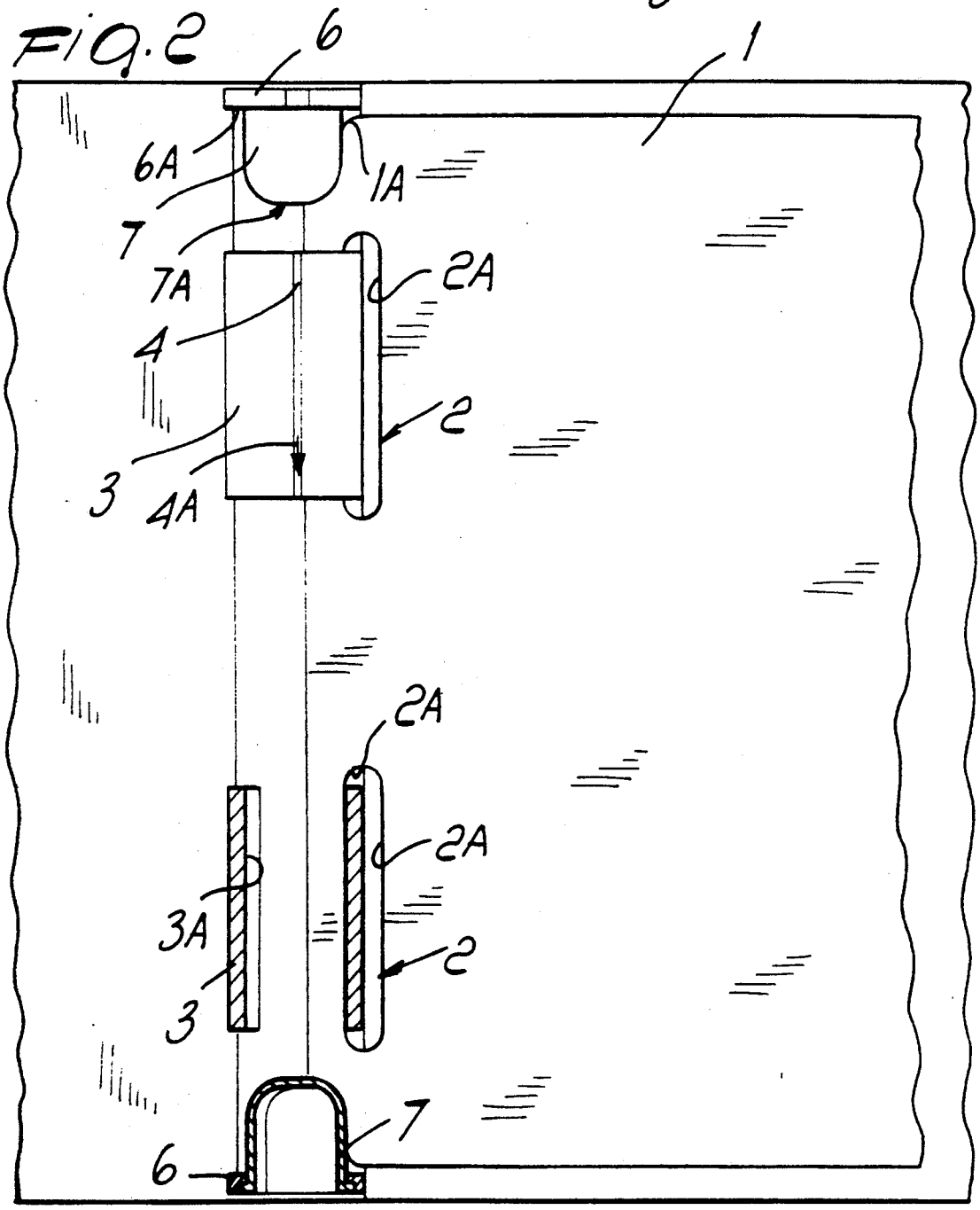
Figure 7:
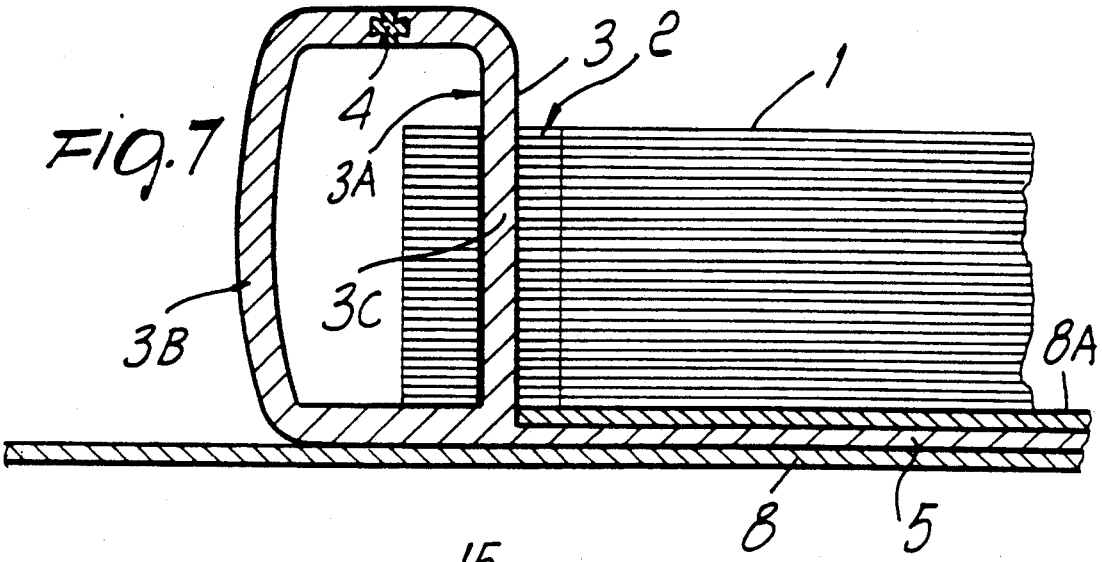
FIGS. 7, 8 and 9 are respectively transverse sectional detail views of the coupling elements of FIGS. 1 to 6.

With reference to the embodiment of FIGS. 1, 2, and 7, the sheets 1, have a pair of through slots 2 which define inner slot edges 2A. Such inner slot edges 2A are engaged by the inner surfaces 3A of raised coupling insertion elements 3 which are advantageously made of plastics and formed monolithically with the base 5 and with frames 6 raised guiding portions 7 are axially inserted and fixed in the frame 6.

As visible from FIGS. 1 and 2, the frames 6 comprise a substantially squared ring engaged by cup-like elements forming the raised portions 7. Advantageously, the frames 6 and raised portions 7 define mutually fitted engagement surfaces 7A and 6A, and the sheets 1 have outer edges which define recessed corners 1A cooperating with the engagement surfaces 7A of the raised portions 7. As visible from FIGS. 1, 2 and 7, each coupling element 3 has a substantially rectangular box-like shape defining two wings 3B and 3C which are upwardly closed by a profiled element 4 which can be extracted in the direction of arrow 4A and is shaped so as to fit with a dovetail coupling in the two edges of the wings 3B and 3C formed by elements 3.

The lower cover is formed by interposing the plastics base 5 between an inner surface covering 8A and an outer covering 8 which extends so as to form the spine and the upper cover.

By virtue of the engagement surfaces 7A of said raised portions 7 and of the shaped inner corners 1A of the outer edges of said sheets 1 at said raised portions, when said sheets are horizontal 1 the inner slot edges 2A of the sheets 2 all rest against the inner surface 3A of the elements 3 and therefore the sheets 1 are perfectly superimposed both longitudinally and transversely.

Figure 3:
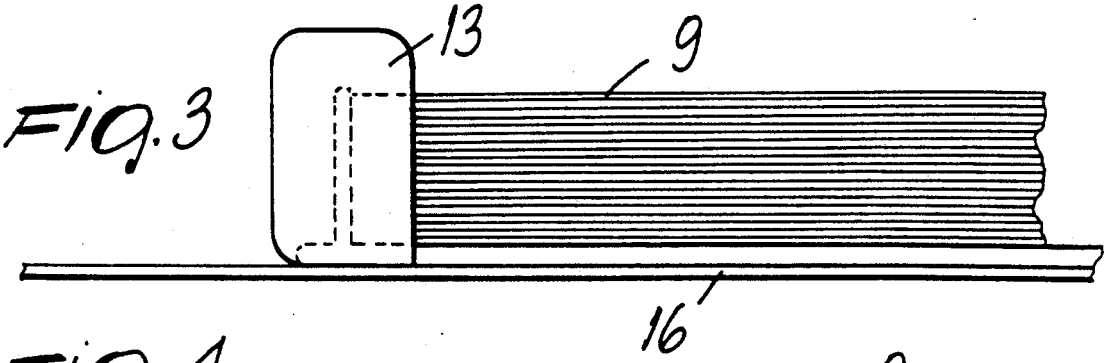
FIGS. 3 and 4 are respectively partially sectional side and front views of an open album in a second embodiment.
Figure 4:
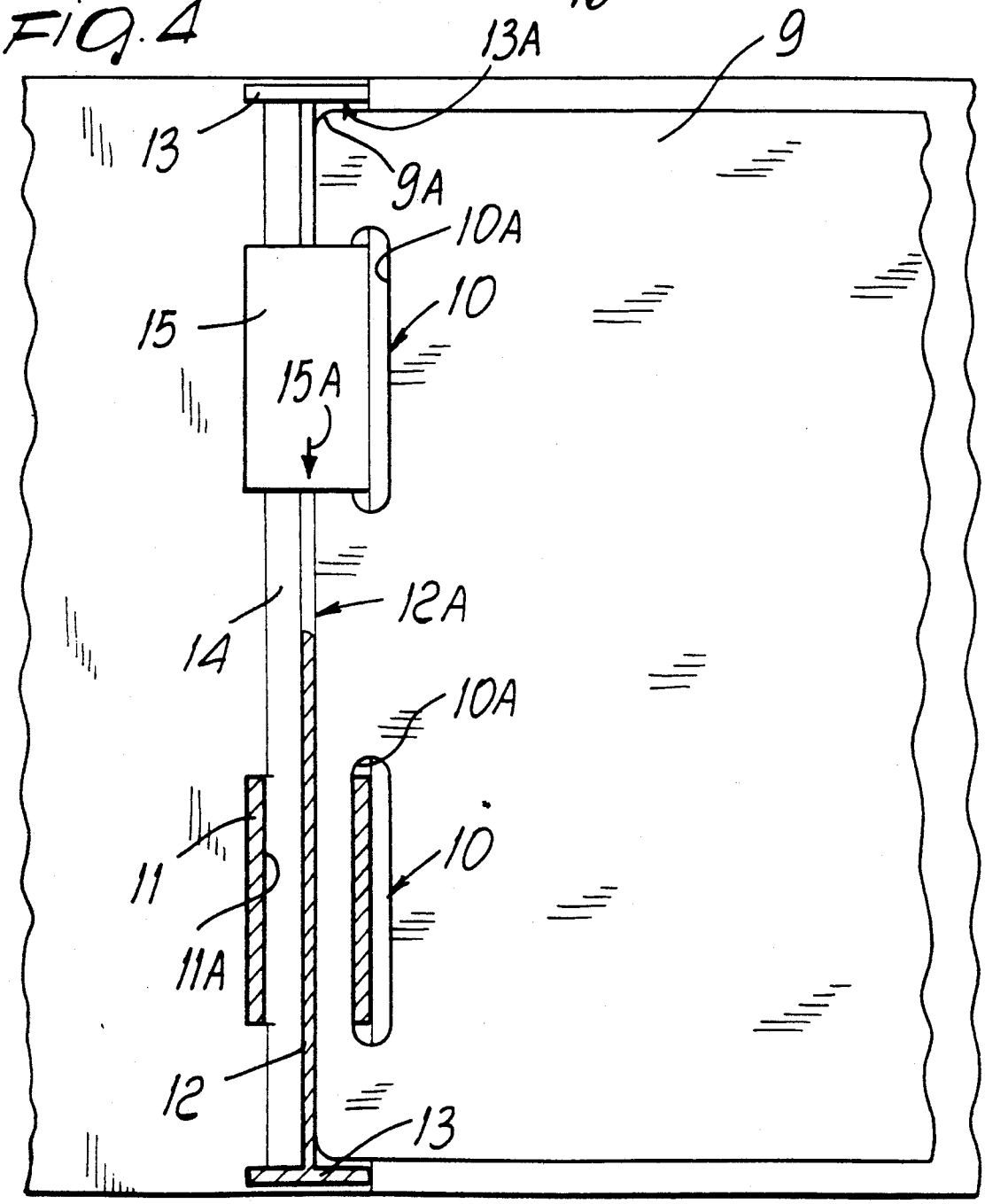
Figure 8:
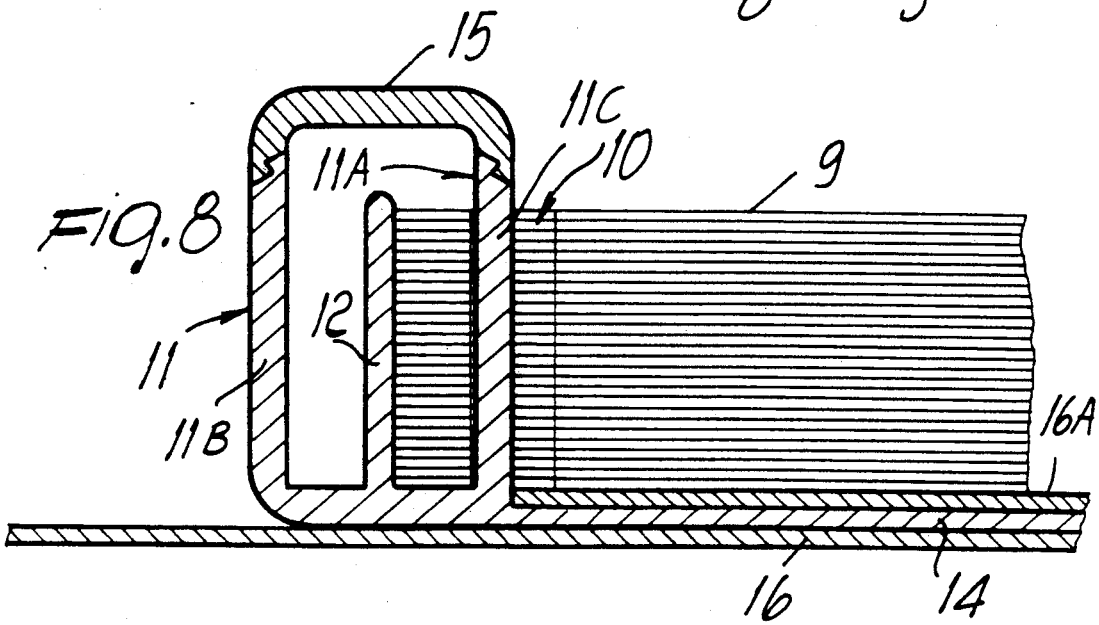

In the embodiment of FIGS. 3, 4, and 8, the sheets 9, have a pair of through slots 10 which define inner slot edges 10A. Such inner slot edges 10A are engaged by the inner surfaces 11A of raised coupling insertion elements 11 which are made of plastics and formed monolithically with the base 14. The base further defines transverse raised guiding portions 13 and a longitudinal raised guiding portion 12 with engagement surfaces 13A and 12A respectively, extending perpendicularly from the base and formed monolithically therewith; said guiding raised portions, which are perpendicular to each other, are intended to ensure, by means of the engagement of outer edges 9A of the sheeets 9 with the engagement surfaces 13A and 12A together with the inner surface 11A engagement with the inner slot edges 10A of the sheets 9, the same arrangement and the perfect superimposition of all the sheets 9.

Each raised coupling insertion element 11 defines two wings, parallel to the longitudinal raised portion 12 and defining teeth engaged by a profiled element 15 in the shape of a rectangular plate which defines, with the coupling element 11, a squared ring and which can be extracted by moving it along the direction of arrow 15*a* (FIG.4).

The lower cover is formed by interposing the plastics base 14 between an inner covering 16A and the outer one 16, and extends to form the spine and the upper cover.

Figure 5:
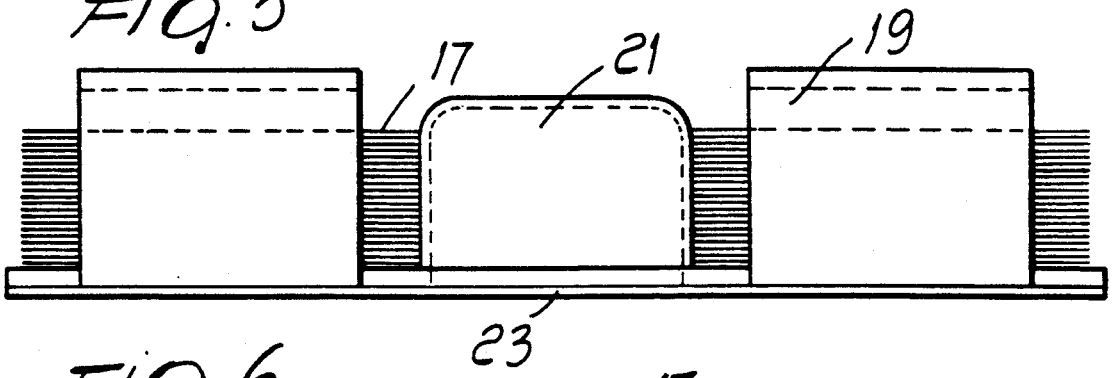
FIGS. 5 and 6 are respectively partially sectional back and front views of an open album in a third embodiment.
Figure 6:
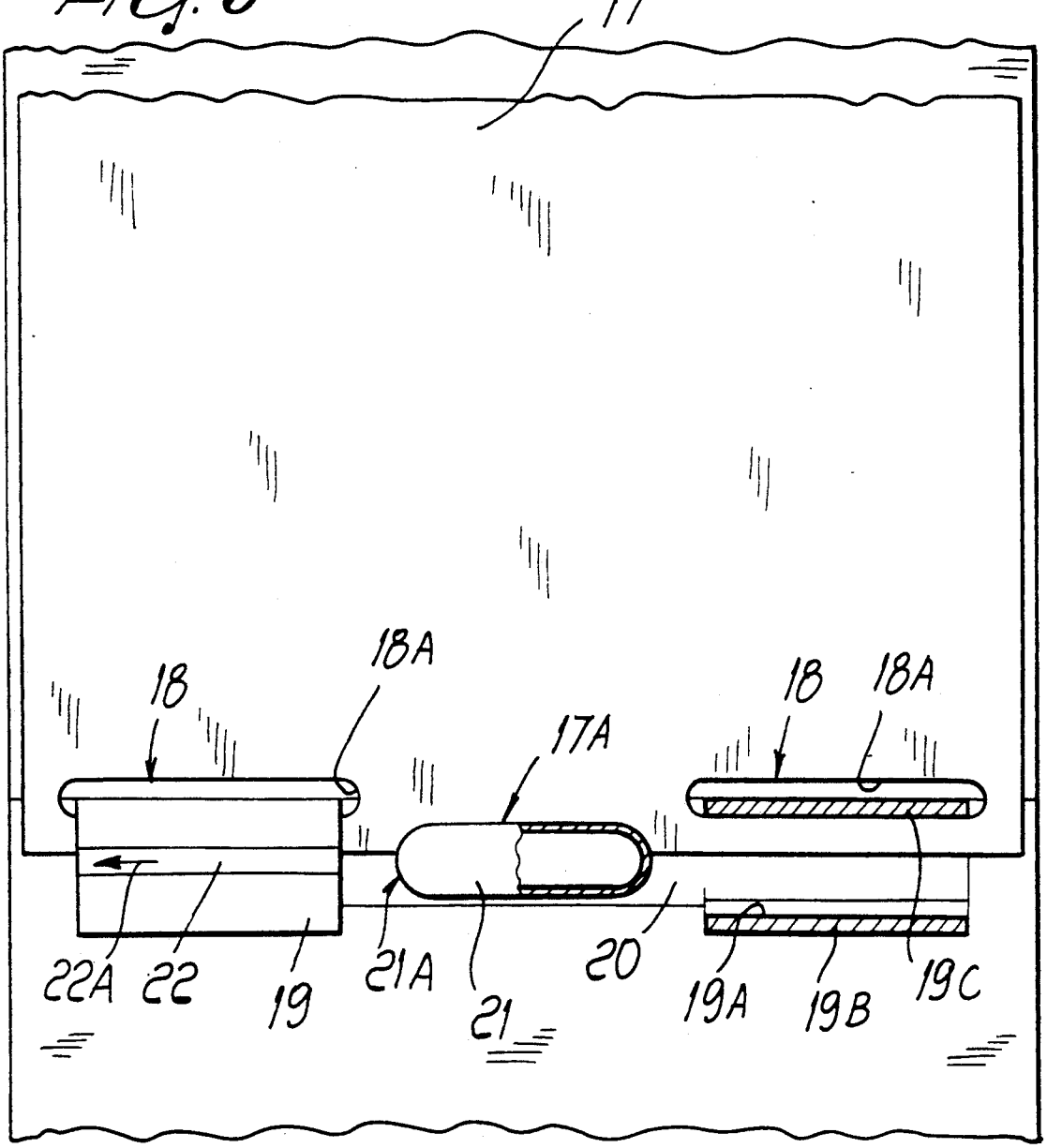
Figure 9:
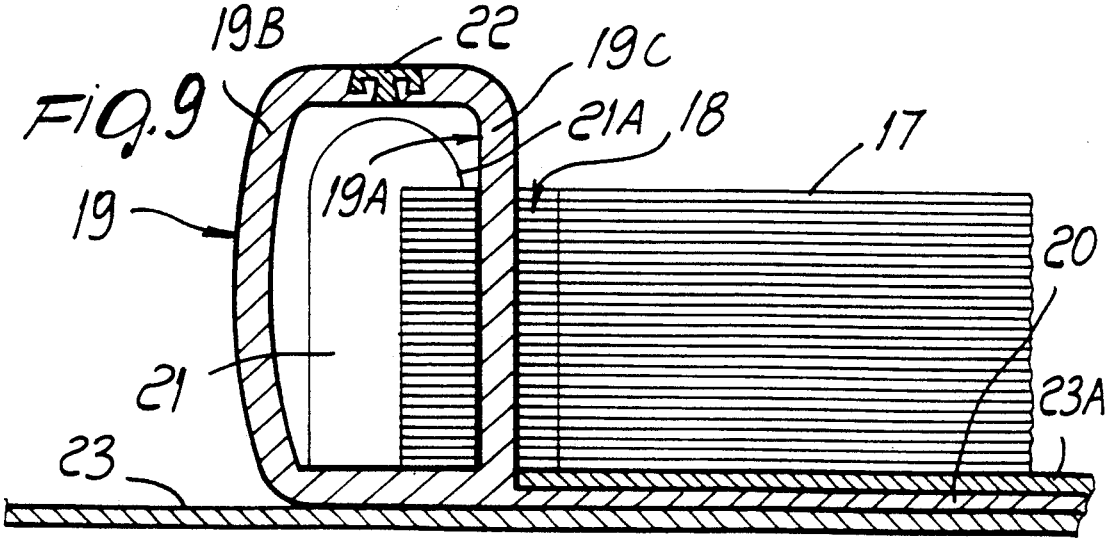

In this embodiment of FIGS. 5, 6 and 9, the sheets 17 have a pair of through slots 18 which define inner slot edges 18A. Such inner slots edges 18A are engaged by the inner surfaces 19A of raised coupling insertion elements 19 defining a pair of wings 19B and 19C having mutually facing ends. The raised coupling insertion elements 19 are made of plastics and formed monolithically with the base 20 and with a central raised guiding portion 21 defining an engagement surface 21A, against which a recessed inner edge 17A of the outer edge of the sheets 17 abuts; said sheets are all perfectly superimposed since their inner slot edges 18A are forced to rest against the inner surface 19A of wings 19*b*.

Each coupling element 19 has a substantially rectangular box-like shape defining two wings 19B and 19C which are upwardly closed by a profiled element 22 which can be extracted in the direction of arrow 22A and is shaped so as to fit with a dovetail coupling between the two shaped ends of the wings 19B and 19C. Also in this case, the lower cover is formed by the base 20, an inner covering 23A and an outer covering 23.

Differently from the previously described embodiments, the album of FIGS. 10–12 has two raised coupling insertion elements 27 having inner surfaces 27A, and two abutment elements or raised guiding portions 29 which define engagement surfaces 29A. The raised guiding portions 29 are defined individually and then fixed in alignment on the inner side of the rear cover 30. The engagement surfaces 29A engage the outer edges 24A of the sheets 24.

Said raised coupling insertion elements may also be accessed from above after extracting a profiled element 28 shaped like those illustrated in FIGS. 7 and 9. Another characteristic of this embodiment resides in the fact that the through slots 26 of the sheets 24 are delimited, at the side facing toward the spine, by a wire 25 which defines the through slot edge which engages with the inner surface 27A of the raised coupling insertion elements 27. Such a wire 25 can be made of steel or other suitable material, which can be fixed to the sheet by folding and glueing a flap thereof as in FIG. 12.

This solution allows to significantly limit the height of the coupling elements 27, i.e. the difference in level between said elements and the thickness of the entire group of sheets.

Figure 13:
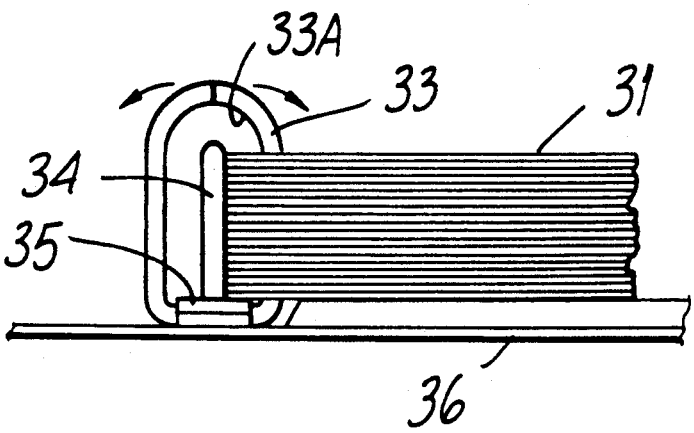
FIGS. 13, 14 and 15 are respectively a side view, a front view and a back view of an open binder provided with known snap-closing coupling means.
Figure 14:
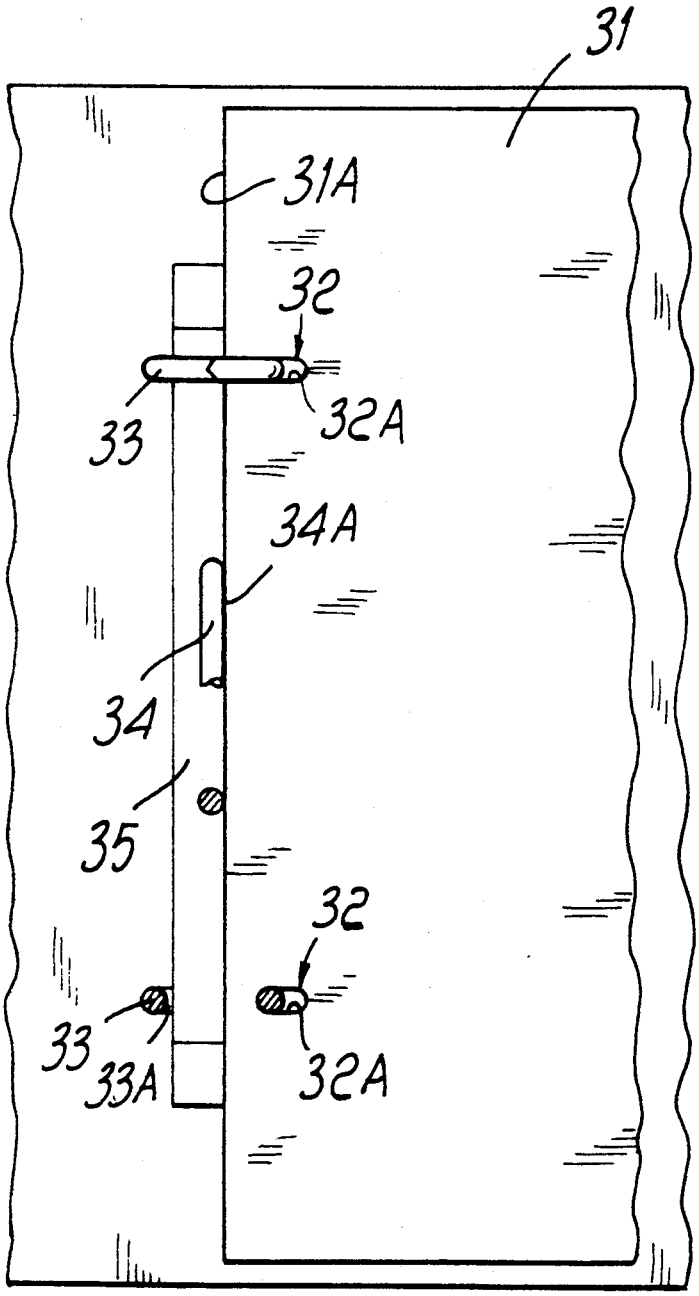
Figure 15:
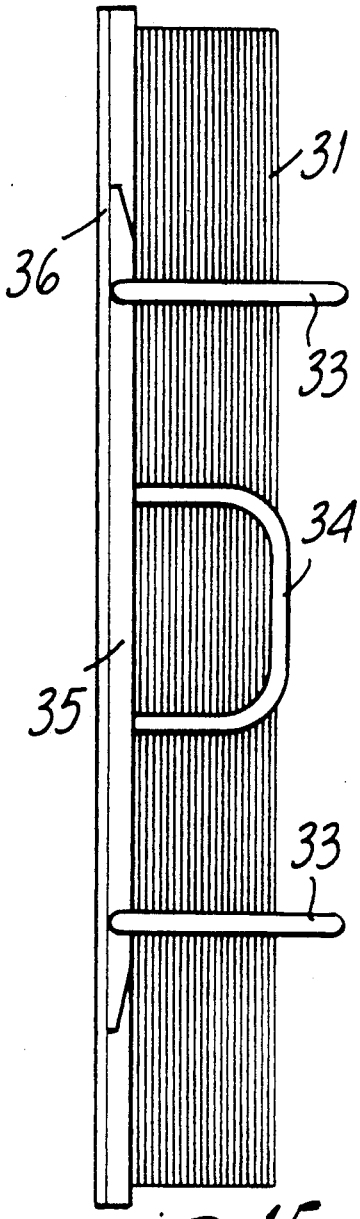

The embodiment according to FIGS. 13–15, illustrates a binder in which the sheets or cards 31 have, instead of two holes, two through slots 32 which define through slot edges 32A which are adapted to facilitate overturning of the sheets 31 along the per se known two raised coupling insertion elements constituted by snap-closing rings 33 which vertically extend from the base 35 fixed to the inner side of the rear cover 36. Inner surfaces 33A of the rings 33 therefore slidably engage the through slot edges 32A. The abutment bracket 34 also vertically extends from said base 35. The engagement surface 34A engages the outer edges 31A of the sheets and, together with the rings 33, keeps the sheets or cards 31 perfectly superimposed.

Though the improvements according to the invention are mainly intended for photo albums and for card binders, this does not exclude their suitability also for other employments which use, according to the instances, sheets or envelopes of any kind and material, for example slide albums; negative albums; coin collection albums; stamp collection albums; record binders; document binders, binders for instalment publications, etc.

I claim:

1. An interchangeable sheet album, comprising a cover and a plurality of sheets, said cover having an inner surface, each sheet of said plurality of sheets defining an outer edge, said each sheet being provided with at least one through slot, said at least one through slot defining an inner slot edge therein, said album further comprising at least one raised coupling insertion element and at least one raised guiding portion, said at least one raised coupling insertion element and said at least one raised guiding portion both being rigidly associated with said inner surface of said cover, said at least one raised coupling insertion element defining an insertion element inner surface, said at least one raised coupling insertion element being insertable inside said at least one through slot such that at least a portion of said inner slot edge of said at least one through slot is slideably engageable with at least a portion of said insertion element inner surface of said at least one raised coupling insertion element, said at least one raised guiding portion defining an engagement surface, said engagement surface at least temporarily engageing and guiding at least a portion of said outer edge of said each sheet, said at least one raised guiding portion and said at least one raised coupling insertion element being mutually arranged on said inner surface of said cover such that said plurality of sheets obtain a longitudinal and transverse superimposition when said plurality of sheets are parallel to said cover.

2. Album according to claim 1, wherein said at least one through slot has a cross sectional area considerably larger than a cross section of said at least one raised coupling insertion element, and wherein said at least one raised guiding portion has a raised height vertical to said cover which is less than a raised height vertical to said cover of said at least one raised coupling insertion element, whereby a turning over of said each sheet is easily facilitated due to a disengagement of said outer edge of said each sheet from said engagement surface and an ample play between said inner slot edge of said at least one through slot and inner surface of said at least one raised guiding portion when said each sheet is raised and turned.

3. Album according to claim 2, wherein said at least one raised coupling insertion element is constituted by two substantially rectangular box-like elements arranged parallel to a spline of said cover, each one of said two substantially rectangular box-like elements defining two upwardly extending wings, a profiled element being provided for a dovetail coupling between a shaped extremity of each said two upwardly extending wings, said profiled element being slidably removable in a direction parallel to the spline of said cover to thereby allow for removal and insertion of said each sheet, said at least one through slot being constituted by two substantially rectangular shaped slots having rounded ends into which said two substantially rectangular box-like elements are inserted, said at least one raised guiding portion being constituted by two cup-like elements, each cup-like element of said two cup-like elements being arranged at a respective end of the spline of said cover, said each cup-like element also being formed with a substantially squared ring at an extremity of the respective end of the spline of said cover, said each sheet having a recessed corner at each respective end of the spline of said cover, said recessed corner defining said outer edge of said each sheet which engages said engagement surface of said each cup-like element and said substantially square ring.

4. Album according to claim 2, wherein said at least one raised coupling insertion element is constituted by two substantially rectangular box-like elements arranged parallel to a spline of said cover, each one of said two substantially rectangular box-like elements defining two upwardly extending wings, each one of said two upwardly extending wings defining teeth at an end thereof, a profiled element in the shape of a rectangular plate being provided which engages said teeth for coupling said two upwardly extending wings, said profiled element in the shape of a rectangular plate being slidably removable in a direction parallel to the spline of said cover to thereby allow for a removal and insertion of said each sheet, said at least one through slot being constituted by two substantially rectangular shaped slots having rounded ends into which said two substantially rectangular box-like elements are inserted, said at least one raised guiding portion being constituted by a longitudinal raised portion and a pair of transverse portions, said longitudinal raised portion extending parallel to the spline of said cover and symetrically extending under said two substantially rectangular box-like elements, each transverse raised portion of said pair of transverse raised portions being arranged at a respective end of the spline of said cover, said outer edge of said each sheet which engages said engagement surface of said longitudinal raised portion and said each transverse raised portion being defined as a straight edge and two corners of said each sheet.

5. Album according to claim 2, wherein said at least one raised coupling insertion element is constituted by two substantially rectangular box-like elements arranged parallel to a spline of said cover, each one of said two substantially rectangular box-like elements defining two upwardly extending wings, a profiled element being provided for a dovetail coupling between a shaped extremity of each said two upwardly extending wings, said profiled element being slidably removable in a direction parallel to the spline of said cover to thereby allow for a removal and insertion of said each sheet, said at least one through slot being constituted by two substantially rectangular shaped slots having rounded ends into which said two substantially rectangular box-like elements are inserted, said at least one raised guiding portion being constituted by a central raised portion arranged between each one of said two substantially rectangular box like elements, said each sheet having a recessed inner edge which defines said outer edge of said each sheet which engages said engagement surface of said central raised portion.

6. Album according to claim 2, wherein said at least one raised coupling insertion element is constituted by two substantially rectangular box-like elements arranged parallel to a spline of said cover, each one of said two substantially rectangular box-like elements defining two upwardly extending wings, a profiled element being provided for a dovetail coupling between an extremity of each said two upwardly extending wings, said profiled element being slidably removable in a direction parallel to the spline of said cover to thereby allow for a removal and insertion of said each sheet, said at least one through slot being constituted by two substantially rectangular shaped slots having rounded ends and having an inner edge being constituted by a continuous wire being fixed to said each sheet by folding and glueing a flap thereof, said continuous wire defining said inner slot edge which engages said inner surface of each one of said two substantially rectangular box-like elements, said at least one raised guiding portion being constituted by two cup-like elements, each cup-like element of said two cup-like elements being arranged at a respective end of the spline of said cover, said each sheet having a recessed corner at each respective end of the spline of said cover, said recessed corner defining said outer edge of said each sheet which engages said engagement surface of said each cup-like element.

7. Album according to claim 2, wherein said at least one raised coupling insertion element is constituted by two snap closing rings, said at least one through slot being constituted by two substantially circular shaped slots into which said two snap closing rings are inserted said at least one raised guiding portion being constituted by an abutment bracket arranged between said two snap closing rings, an inner edge portion of said each sheet defining said outer edge of said each sheet which engages said engagement surface of said abutment bracket.

8. Album according to claim 2, further comprising a base element and an inner covering, said at least one raised guiding portion and said at least one raised coupling insertion element both being formed monolithically with said base element, said base element being interposed between said inner covering and said inner surface of said cover to thereby connect said at least one raised coupling insertion element and said at least one raised guiding portion to said inner surface of said cover, said base element, said at least one raised guiding portion and said at least one raised coupling insertion element all being made of plastics.

* * * * *